United States Patent [19]

Anderson

[11] Patent Number: 4,457,351

[45] Date of Patent: Jul. 3, 1984

[54] TILT ROD SUPPORT FOR VENETIAN BLIND ASSEMBLY

[75] Inventor: Richard N. Anderson, Owensboro, Ky.

[73] Assignee: Hunter Douglas, Inc., Totowa, N.J.

[21] Appl. No.: 500,389

[22] Filed: Jun. 2, 1983

Related U.S. Application Data

[63] Continuation-in-part of Ser. No. 387,033, Jun. 10, 1982, , which is a continuation-in-part of Ser. No. 290,259, Aug. 5, 1981, abandoned.

[30] Foreign Application Priority Data

Jun. 9, 1982 [CA] Canada ..... 404836

[51] Int. Cl.[3] ..... E06B 9/38

[52] U.S. Cl. ..... 160/178 R

[58] Field of Search ..... 160/166–178 R, 160/178 B, 178 C; 211/60 T; 248/49, 201, 251, 255, 300

[56] References Cited

U.S. PATENT DOCUMENTS

| | | | |
|---|---|---|---|
| 3,269,453 | 8/1966 | Vecchiarelli | 160/176 |
| 3,298,425 | 1/1967 | Cryton et al. | 160/178 R |
| 3,325,131 | 6/1967 | Englander et al. | 248/300 |
| 3,333,905 | 8/1967 | Hennequin | 160/178 R |
| 3,689,193 | 9/1972 | Riehl | 248/300 |
| 4,177,853 | 12/1979 | Anderson et al. | 160/178 R |

*Primary Examiner*—Peter M. Caun

*Attorney, Agent, or Firm*—Pennie & Edmonds

[57] ABSTRACT

Tilt rod support adapted to be inserted into a venetian blind headrail to support a tilt rod directly or through the intermediary of a tape roll mounted on a tilt rod. The support has two vertical support portions having curved surfaces with each surface extending less than 180° of arc whereby a tape roll may be snapped into place between the vertical support portions. The tilt rod support includes flexible barbs and shoulders adapted to engage the sides of a route hole cut in a web of a headrail to lock the support in place in a headrail.

10 Claims, 10 Drawing Figures

FIG. 5
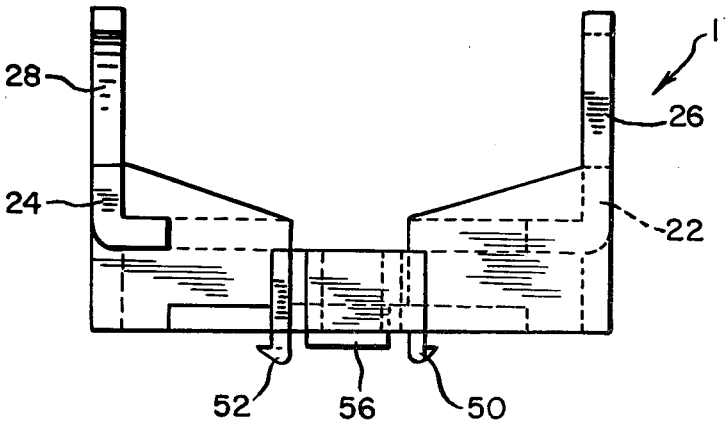
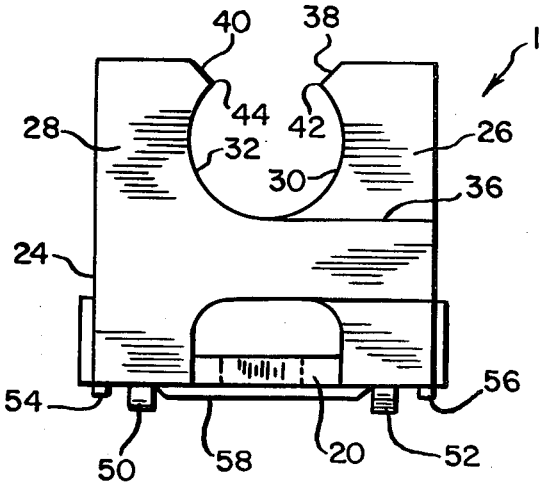
FIG. 6
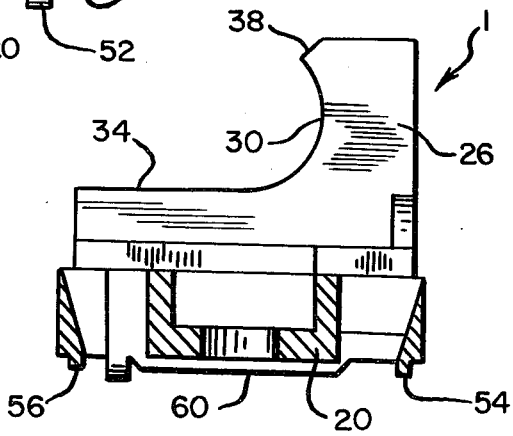
FIG. 7

TILT ROD SUPPORT FOR VENETIAN BLIND ASSEMBLY

CROSS-REFERENCE TO OTHER APPLICATIONS

This application is a continuation-in-part of my copending application Ser. No. 387,033 filed June 10, 1982 in turn a continuation-in-part of my application Ser. No. 290,259 filed Aug. 5, 1981, now abandoned.

FIELD OF THE INVENTION

This invention relates to a tilt rod support for a venetian blind assembly and more particularly to a tilt rod support that may be fitted into a venetian blind headrail in order to support a ladder tape in turn supporting venetian blind slats and where the support bears directly on the rod or through the intermediary of a tape roll.

BACKGROUND OF THE INVENTION

Tape rolls mounted on tilt rods are utilized to support ladder tapes or ladder cords which in turn support the slats of a venetian blind assembly. Such rolls are usually rotatably mounted inside of channel shaped headrails utilizing a tape roll support. Because the headrail may be relatively small and have small openings in the channel shape, it often is difficult to easily mount the tape roll support in the headrail and at the same time be assured it will be locked into position.

Further there is often a problem of assembling the tape roll and tilt rod with the tape roll support and at the same time assuring that the roll-rod assembly will remain assembled with the support while the complete blind assembly is being attached to a building structure and through operation of the blind.

It is desirable that any tape roll support and fastening of the support not distract from the overall appearance of the blind. To this end, the roll support is usually completely enclosed by the headrail and any means for fastening the support to the headrail should be as inconspicuous as possible.

Still further, any roll support should be of a construction that is easy to manufacture, and where made of a plastic material, might be easily molded without use of complicated expensive dies which increases tooling costs.

It is therefore an object of my invention to provide for a tilt rod support which may be readily positioned in a headrail and which may be readily assembled with a tape roll and to assure that the support will remain assembled with the rod and tape roll during further installation of the blind and during usage of the blind.

It is a further object of my invention to provide a tilt rod support which may comprise a plastic molded material and a configuration so not to require use of complicated mold shapes or require use of molds manufactured to any high degree of tolerance.

GENERAL DESCRIPTION OF THE INVENTION

Broadly a tilt rod support constructed according to my invention has a base adapted to engage with an inner surface of a web of a channel shaped headrail. Two parallel spaced legs extend upwardly from the base and each has thereon a vertical support portion adapted to engage a part of the periphery of a tilt rod or a tape roll mounted on the rod. In one form of the invention, each vertical support portion includes a circular surface which extends less than 180°. The circular surfaces of the legs face in opposite directions so as to engage opposite sides of a tilt rod or a tape roll. The circular surfaces of both vertical support portions together extend more than 180° but less than 360°. By this construction a tilt rod or a tape roll may be forced down to slightly spread the legs whereby the rod or roll may be snapped into position between the legs on the circular surfaces.

The extension of both surfaces more than 180° prevents the rod or roll from falling out of the support. Preferably the top of the vertical support portions have slanting guide surfaces at their top adjacent the curved surfaces in order to guide the tilt rod or tape roll into place and to assist in spreading the vertical upstanding portions of the support during installation of the rod and attached roll.

In a further form of the invention, each vertical support of the tilt rod support has a hold down tab at the top thereof to retain a tilt rod or tilt roll in the support. Each tab extends obliquely with respect to the longitudinal axis of the roll or rod and is adapted to be deflected outwardly of the longitudinal axis when engaged by a rod or roll on insertion of the same in the support. Preferably each tab has a slanted upper surface which when engaged by a rod or roll vectors the engaging force between the parts to deflect the tab.

The support in both forms of the invention preferably has a plurality of flexible barbs and fixed shoulders extending downwardly from the bottom side of the base adapted to engage a route hole in the web of a headrail through which a tape ladder or cable is adapted to extend. The shoulders and barbs position and lock the tilt rod support in the headrail. Two of the shoulders define two sides of a quadrangle while the flexible barbs are positioned at the two remaining sides of the quadrangle and at opposite corners thereof.

The tilt rod support is conventionally made of a plastic molded material, and because of its configuration, may be shaped in a mold without using core pulls thus reducing cost of tooling.

BRIEF DESCRIPTION OF THE DRAWINGS

FIG. 5 is a side view of the rod support of FIG. 1;

FIG. 6 is an end view of the rod support of FIG. 1;

FIG. 7 is a sectional view of the rod support of FIG. 1 taken along lines 7—7 of FIG. 4;

DESCRIPTION OF THE PREFERRED EMBODIMENT

Figure 1:
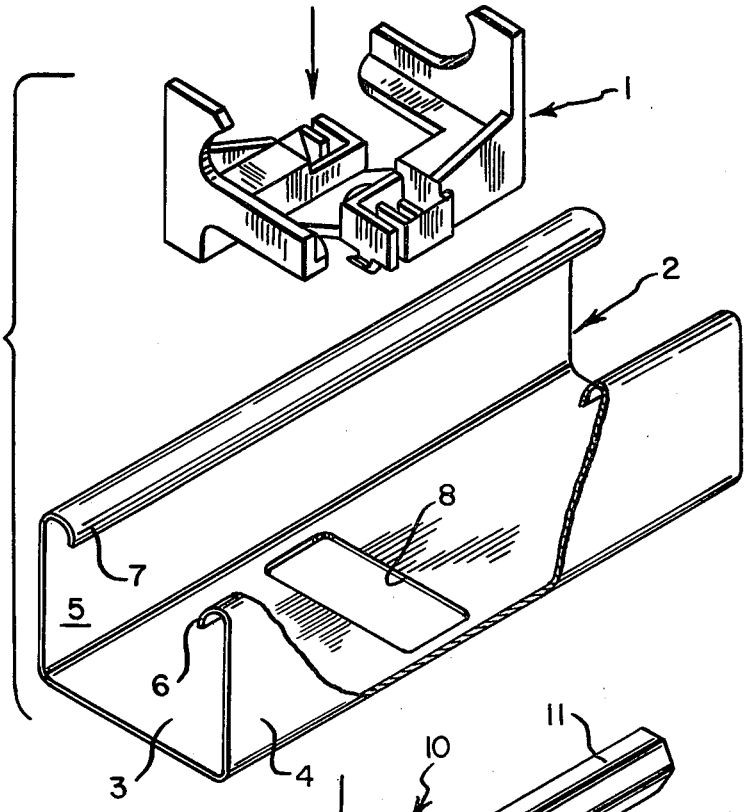
FIG. 1 is a perspective view of a tilt rod support constructed according to the invention illustrating the manner in which it is applied to a headrail.

Referring to FIG. 1, there is illustrated a tilt rod support 1 constructed according to the invention being applied to a channel shaped headrail 2 having a web 3 joining two upstanding legs 4 and 5 having inturned ends 6 and 7. The headrail has a conventional route hole 8 in the form of a quadrangle through which tape ladders or cords are adapted to pass. The support 1 is adapted to be inserted into the headrail 2 by pushing the support downwardly until barbs on the support engage in and lock on edges of the route hole 8 as explained in greater detail hereafter.

Figure 2:
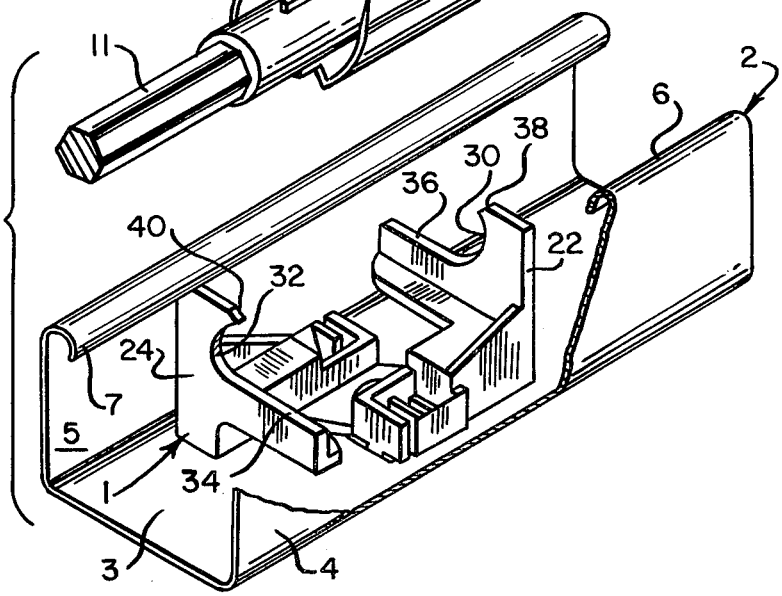
FIG. 2 is a perspective view of a tilt rod having a tape roll thereon being applied to the rod support of FIG. 1.

Referring to FIG. 2, the support 1 is shown positioned in the headrail. FIG. 2 further shows a tape roll 10 mounted on a tilt rod 11 being positioned on the support 1 by a vertical downwardly movement as will be explained hereafter in greater detail.

Figure 3:
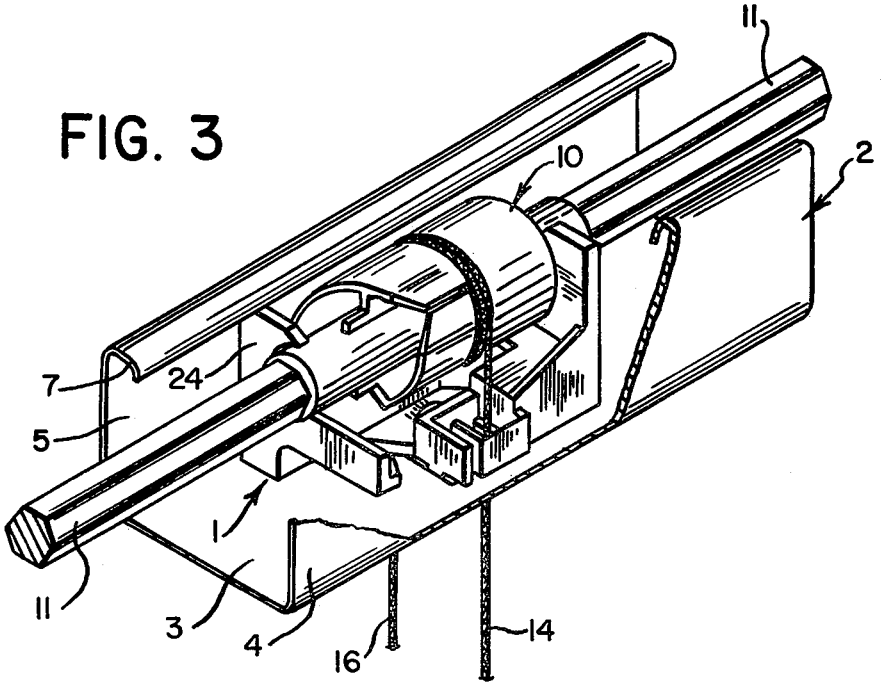
FIG. 3 is a perspective view of the rod of FIG. 2 applied to a rod support through the intermediary of a tape roll.

FIG. 3 illustrates the complete assembly of the tilt rod 11 in the headrail through the intermediary of the tape roll 10 and further shows ladder cords 14 and 16 mounted on the roll 10.

The tilt rod support 1 as shown in FIGS. 4–7 comprises a base 20 having two parallel spaced upstanding legs 22 and 24. The legs 22 and 24 respectively have a vertical support portion 26 and 28 with each vertical support portion including a curved surface 30 and 32 adapted to engage a part of the periphery of the tape roll 10. As shown in FIG. 6, the curved surface of each vertical support portion extends less than 180° of arc and preferably about 135°. The lower portion of each curved surface joins with a horizontally extending surface 34 and 36 respectively which is tangent to the curved surface. The curved surface and horizontally extending surfaces of each support together form a bearing surface.

The upper end of each curved surface joins with a guide surface 38 and 40 which serves to guide and assist the positioning of a tape roll on the support. As shown in FIG. 2, the tape roll is pushed downwardly onto the guide surfaces. Further pressure on the tape roll will cause the legs to flex slightly to spread apart allowing the roll to be moved past the corners 42 and 44 after which the legs will snap back into place to hold the roll in position.

The use of two vertical support portions located on opposite sides of the tape roll tends to keep the roll and rod aligned and supported in the headrail provided that two such tilt rod supports are used or that one such tape roll support is used in conjunction with an end member which prevents misalignment of the opposite end of the tilt rod or that one such tape roll is used in conjunction with a single vertical support member adjacent an opposite end of the tilt rod which prevents skewing of the rod in a direction away from the curved surfaces of the single tape roll support.

Figure 4:
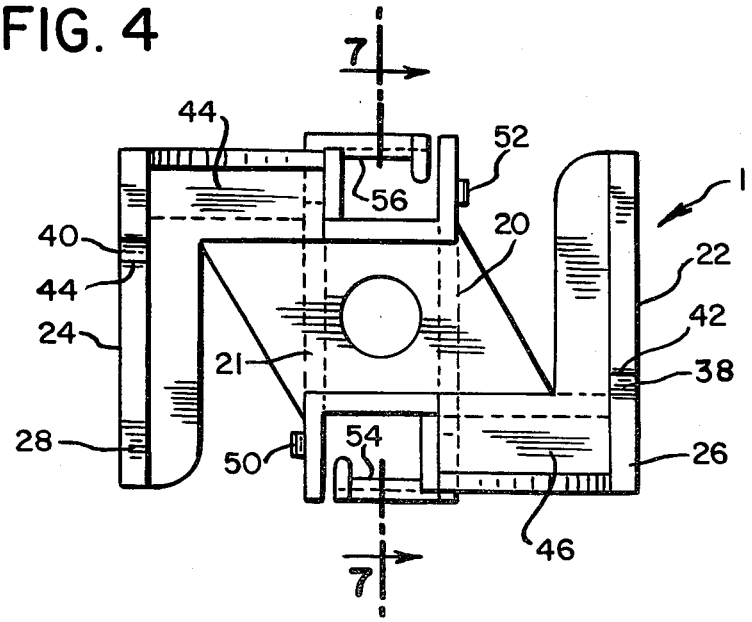
FIG. 4 is a plan view of the rod support of FIG. 1.

In order to increase the flexibility of the vertical legs 22 and 24 so that they may be spread apart on insertion of the tape roll, the base 20 which is Z-shaped is joined at opposite ends to L-shaped sub-base sections 44 and 46. As shown in FIG. 4, one leg of each L-shaped sub-base section is connected to the base 20 while the other leg is connected with a vertical extending leg.

The overhang of the corners 42 and 44 prevents the tape roll from becoming dislodged from the support during further handling of the venetian blind assembly as may occur during installation or removal for cleaning purposes.

The tilt rod support 1 has a plurality of flexible barbs 50 and 52 extending down from the base 20 as well as a plurality of fixed shoulders 54, 56, 58 and 60 which also extend down from the base 20. Shoulders 54–60 extend along the side of a quadrangle at the center section 21 of the base having the same general dimensions of the quadrangular shaped route hole 8 in the headrail. The flexible barbs are positioned at adjacent opposite corners of the quadrangle.

The tilt rod support is inserted into the headrail so that the shoulders 54–60 and barbs 50 and 52 engage the sides of the route hole. The support is then pressed down forcing the barbs inwardly towards one another until they extend beneath the surface of the base 20 after which they snap back locking the support in the headrail.

Figure 8:
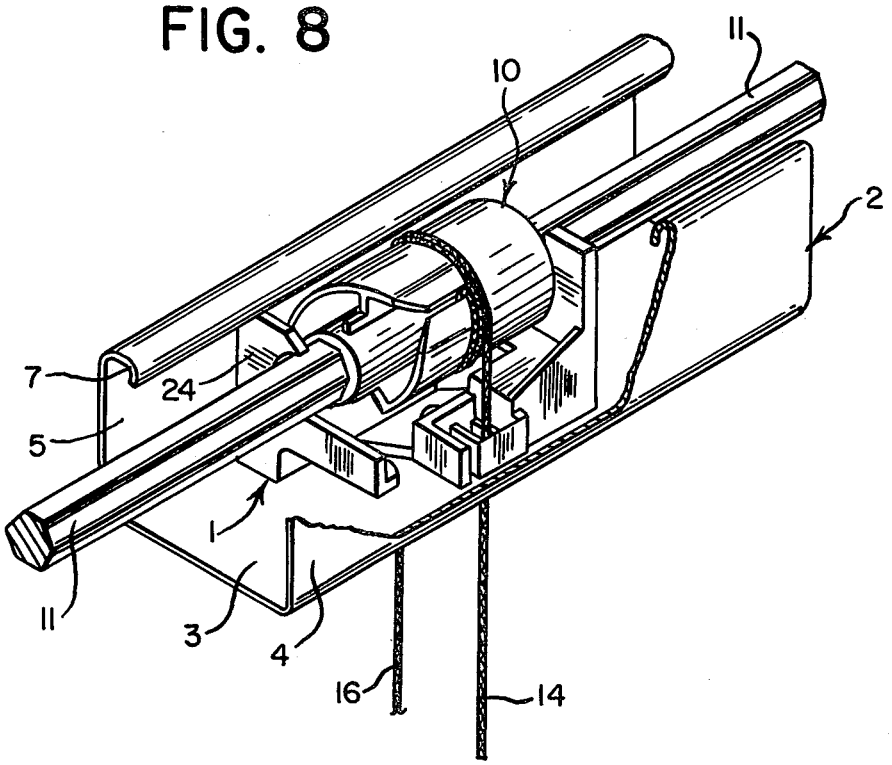
FIG. 8 is a perspective view of a tilt rod applied directly to a rod support.

Instead of bearing on the tilt rod through the intermediary of a tape roll as shown in FIG. 3, the tilt rod support may bear directly on the periphery of the tilt rod itself as shown in FIG. 8. In this event, the vertical legs 22 and 24 are spaced accordingly and the curved surfaces 30 and 32 of each are adapted to engage the apexes of the outer periphery of the rod.

Figure 9:
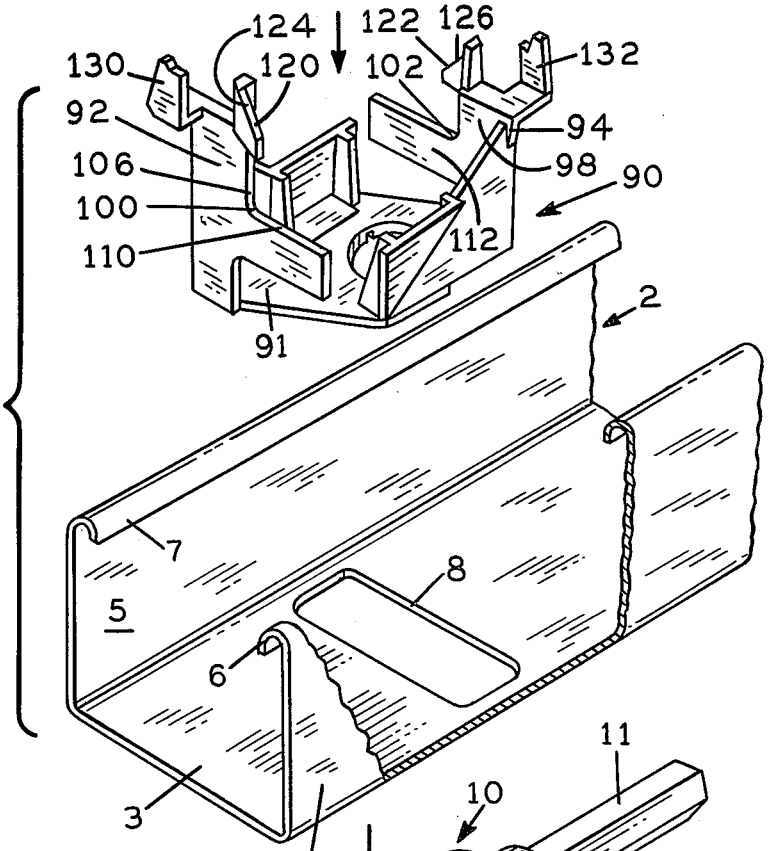
FIG. 9 is a perspective view of a further form of a tilt rod support constructed according to the invention.
Figure 10:
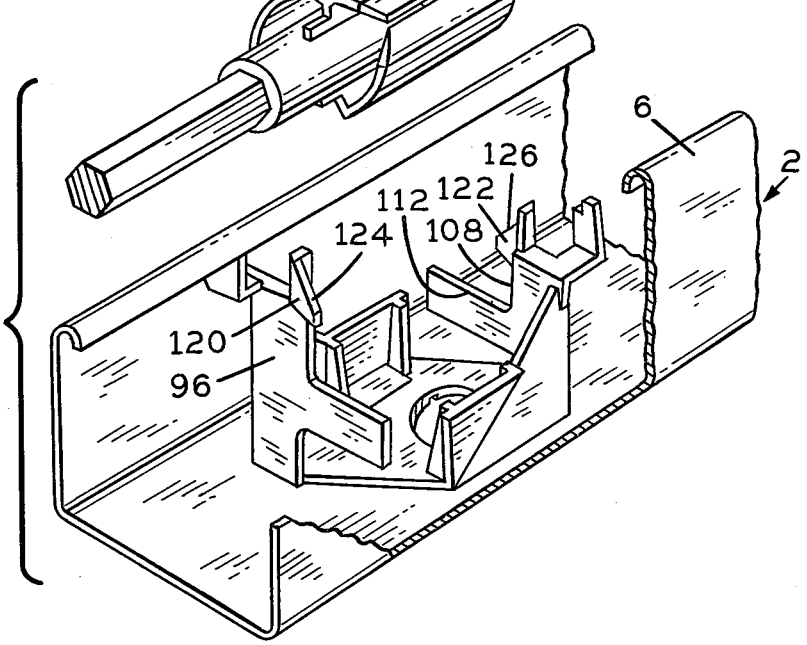
FIG. 10 is a perspective view of a tilt rod having a tape roll thereon being applied to the rod support of FIG. 1.

Referring to FIGS. 9 and 10, in which like parts have like identifying numerals, there is illustrated a further form of a tilt rod support 90. As shown the support 90 comprises a base 91 having two spaced upstanding legs 92 and 94. The legs 92 and 94 respectively have vertical supports 96 and 98 with each vertical support including a curved surface 100 adapted to engage the periphery of a tape roll 10, or as in the manner of FIG. 8, the periphery of a tilt rod 11. The curved surfaces 100 and 102 each extend approximately 90° of arc and merge respectively with vertical surfaces 106 and 108 and horizontal surfaces 110 and 112.

Hold down tabs 120 and 122 are connected to the top of the legs 92 and 94 and extend at an angle approximately 45° inwardly towards the center of the support. The tabs have slanted upper surfaces 124 and 126 respectively such that when a tilt rod or roll is pushed down into contact with the surfaces 124 and 126, the resultant forces will deflect the tabs outwardly of the center of the support allowing the rod or roll to be snapped into position to engage the horizontal surfaces 110 and 112 after which the tabs will snap back into the position shown in the drawings. The tabs after snap back will then serve to hold the rod or roll in place on the support.

Alignment of the rod or roll is maintained in the same manner as with the support of FIGS. 1–8 and the base of the support is positioned in the headrail by shoulders on the base engaging the periphery of the cutout 8 in the web of the headrail in the same manner as the first described support.

The support 90 may in addition be provided with notched extensions 130 and 132 adapted to engage the inturned ends 6 and 7 of the headrail to further provide a locking engagement of the support within the headrail.

The rod itself in cross section may be in the shape of a square, hexagon, sector of a circle or any symmetrical shape provided that the angles between flats in cross section or between a cord and an arc in cross section do not exceed 90° plus the angle from the horizontal taken from the center of the opening between the two legs 22 and 24 and the corners 42 and 44 of the legs which total angle is usually about 135°.

The tilt rod support described is capable of being molded as a one-piece unit thus reducing tooling costs and providing for a lower part cost. Further the provision of the vertical supports having curved surfaces extending less than 180° reduces the need for close dimensional control thus further reducing manufacturing and tooling costs.

I claim:

1. A tilt rod support adapted to be fitted into a venetian blind headrail having a channel-shaped cross-section including a lower web, said tilt rod support being made of a resilient material and comprising a base adapted to engage said web, two longitudinally spaced parallel upstanding legs on said base, each said leg having a vertical support portion comprising a bearing surface extending less than 180° of circumference, and the bearing surface of the vertical support portion of one leg facing in the opposite direction of the bearing surface of the vertical support portion of the other leg, said bearing surfaces being dimensioned and shaped to rotatably support a tilt rod, and said legs being dimensioned and shaped to receive a tilt rod therebetween when a rod is forced downwardly on said legs to cause said legs to spread radially outwardly from said rod to allow said rod to snap into place between said legs.

2. A tilt rod support according to claim 1 where said bearing supports are dimensioned and shaped to rotatably support the tilt rod through the intermediary of a tape roll mounted on said tilt rod.

3. A tilt rod support according to claim 1 where the bearing surfaces of both said vertical support portions together extend more than 180° and less than 360° and whereby a tilt rod may be inserted between said vertical legs by forcing said rod downwardly on said legs to cause the legs to spread radially outwardly from said rod to allow said vertical support surface to snap into place around the periphery of the rod.

4. A tilt rod according to claim 3 wherein the top of each said vertical support portion has a downwardly extending guide surface adjacent an end of the circular surface adapted to guide the tilt rod and assist in spreading the legs when the tilt rod is inserted in said support.

5. A tilt rod support according to claim 1 wherein said bearing surface of each said vertical support surface ends in a horizontally extending surface tangent to the curved surface.

6. A tilt rod support according to claim 1 having in addition a plurality of flexible barbs extending downwardly from a lower side of said base and a plurality of fixed shoulders extending downwardly from said lower side whereby said support may be locked in position in a headrail by said shoulders and barbs engaging the sides of a route hole in said web of a headrail.

7. A tilt rod support according to claim 6 having four said shoulders which define the side of a center section of said base in the form of a quadrangle and having two said barbs located on two side of said quadrangle and at opposite corners thereof.

8. A tilt rod support according to claim 1 wherein said base is Z-shaped with said upstanding legs joined at the bottom ends to the legs of the Z-shaped base and wherein the free ends of the legs of the Z-shaped base point away from the bearin surfaces of the upstanding legs whereby the flexibility of the upstanding legs is increased.

9. A tilt rod support according to claim 1 wherein each leg has a hold down tab connected to the end thereof opposite said base extending obliquely inwardly towards the center of the support and adapted to retain a tilt rod in said support.

10. A tilt rod support according to claim 9 wherein each said tab has a tapered upper surface tapered downwardly towards said base whereby when said tapered surface is engaged by a tilt rod or a tilt roll, said tab will be deflected outwardly to allow said rod or roll to be moved downwardly past said tab to be positioned on said bearing surfaces.

* * * * *

UNITED STATES PATENT AND TRADEMARK OFFICE

CERTIFICATE OF CORRECTION

PATENT NO. : 4,457,351

DATED : July 3, 1984

INVENTOR(S) : Richard N. Anderson

It is certified that error appears in the above-identified patent and that said Letters Patent is hereby corrected as shown below:

Delete item [30] on the title page referring to any foreign application priority date.

Signed and Sealed this

*First* Day of *January 1985*

[SEAL]

*Attest:*

GERALD J. MOSSINGHOFF

*Attesting Officer*

*Commissioner of Patents and Trademarks*